US009653029B2

(12) United States Patent
Wang et al.

(10) Patent No.: US 9,653,029 B2
(45) Date of Patent: May 16, 2017

(54) CONCURRENTLY REFRESHING MULTIPLE AREAS OF A DISPLAY DEVICE USING MULTIPLE DIFFERENT REFRESH RATES

(71) Applicant: Apple Inc., Cupertino, CA (US)

(72) Inventors: Chaohao Wang, Cupertino, CA (US); Szu-Hsien Lee, Cupertino, CA (US); Paolo Sacchetto, Cupertino, CA (US); Shih Chang Chang, Cupertino, CA (US); Chun-Yao Huang, Cupertino, CA (US); Paul S. Drzaic, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 26 days.

(21) Appl. No.: 14/558,663

(22) Filed: Dec. 2, 2014

(65) Prior Publication Data

US 2016/0042708 A1 Feb. 11, 2016

Related U.S. Application Data

(60) Provisional application No. 62/033,586, filed on Aug. 5, 2014.

(51) Int. Cl.
*G09G 3/36* (2006.01)
*G09G 3/32* (2016.01)

(52) U.S. Cl.
CPC ..... *G09G 3/3611* (2013.01); *G09G 3/32* (2013.01); *G09G 2310/04* (2013.01); *G09G 2320/0247* (2013.01); *G09G 2320/103* (2013.01); *G09G 2340/0435* (2013.01)

(58) Field of Classification Search
CPC ..... G09G 3/3611; G09G 2340/0435; G09G 2320/103; G09G 2320/0247
See application file for complete search history.

(56) References Cited

U.S. PATENT DOCUMENTS

| | | | |
|---|---|---|---|
| 6,346,970 | B1 | 2/2002 | Boehlke |
| 6,456,268 | B1 | 9/2002 | Takeda |
| 2002/0126112 | A1 | 9/2002 | Kato |

(Continued)

FOREIGN PATENT DOCUMENTS

| | | | |
|---|---|---|---|
| CN | 101882417 | A | 11/2010 |
| KR | 10-2006-0066424 | A | 6/2006 |
| KR | 10-2013-0079623 | A | 7/2013 |

OTHER PUBLICATIONS

PCT Application No. PCT/US2015/040632—International Search Report and Written Opinion dated Nov. 4, 2015.

*Primary Examiner* — Shaheda Abdin
(74) *Attorney, Agent, or Firm* — Downey Brand LLP

(57) ABSTRACT

This application relates to methods and apparatus for refreshing a display device at various frequencies. Specifically, multiple areas of the display device can be refreshed concurrently at different frequencies. In this way, when static content is being displayed in certain areas of the display device, those certain areas can be refreshed at a lower rate than areas displaying dynamic content such as video or animation. By refreshing at lower rates, the energy consumed by the display device and subsystems associated with the display device can be reduced. Additionally, processes for reducing flicker when refreshing the display device at different refresh rates are disclosed herein.

18 Claims, 11 Drawing Sheets

(56) References Cited

U.S. PATENT DOCUMENTS

| | | | | |
|---|---|---|---|---|
| 2007/0030224 | A1* | 2/2007 | Youn | G09G 3/3648 345/88 |
| 2007/0063959 | A1 | 3/2007 | Iwabuchi et al. | |
| 2007/0273682 | A1* | 11/2007 | Yi | G09G 3/3611 345/211 |
| 2008/0001863 | A1 | 1/2008 | Kim et al. | |
| 2008/0018571 | A1* | 1/2008 | Feng | G09G 3/3648 345/87 |
| 2009/0251445 | A1 | 10/2009 | Ito et al. | |
| 2009/0295706 | A1* | 12/2009 | Feng | G09G 3/342 345/102 |
| 2013/0265294 | A1* | 10/2013 | Kim | G09G 3/20 345/214 |
| 2014/0002465 | A1 | 1/2014 | Kwa et al. | |
| 2014/0085276 | A1 | 3/2014 | Jang et al. | |
| 2014/0198093 | A1 | 7/2014 | Nambi et al. | |
| 2015/0179094 | A1 | 6/2015 | Kim et al. | |
| 2016/0042707 | A1 | 2/2016 | Wang et al. | |

* cited by examiner

CONCURRENTLY REFRESHING MULTIPLE AREAS OF A DISPLAY DEVICE USING MULTIPLE DIFFERENT REFRESH RATES

CROSS REFERENCE TO RELATED APPLICATIONS

This application claims the benefit of U.S. Provisional Patent Application No. 62/033,586, filed Aug. 5, 2014, and entitled "CONCURRENTLY REFRESHING MULTIPLE AREAS OF A DISPLAY DEVICE USING MULTIPLE DIFFERENT REFRESH RATES," which is incorporated by reference herein in its entirety for all purposes.

This application is related to U.S. application Ser. No. 14/472,272, filed Aug. 28, 2014, and entitled "CONCURRENTLY REFRESHING MULTIPLE AREAS OF A DISPLAY DEVICE USING MULTIPLE DIFFERENT REFRESH RATES," which is incorporated by reference herein in its entirety for all purposes.

FIELD

The described embodiments relate generally to modifying refresh rates of a display device. More particularly, the present embodiments relate to methods and apparatus for concurrently refreshing multiple areas of a display device at different rates.

BACKGROUND

Recent advances in computing devices have allowed for visually stunning graphics on many light, and often portable, computing devices. The graphics can be provided through a variety of systems that incorporate a graphics processor and a display monitor. Many graphics processors can interact with a display monitor to provide images and video that can update or refresh without any interruption being perceived by the user of the display monitor. However, both the transmission of data and the emissions of light from the display monitor for prolonged periods necessitate quantities of energy typically not available when implemented in portable computing devices. Often times this energy is devoted to transitions between colors and brightness levels of the display, and therefore designing a display that does not provide as optimal of transitions can degrade the user experience with the computing device. As a result, manufacturers must often make a choice between providing a more impressive visual display or conserving energy in order to provide a longer battery life for the computing device.

Many computing devices are primarily used for internet browsing, which can often require a variety of graphics to be displayed. For instance, some web pages are devoted to streaming videos and therefore can demand a lot of effort from the graphics processor of a computing device. In order to provide smooth streams of videos, the display monitor should be refreshed at a rate that allows for the video to be smoothly presented on the display monitor. However, maintaining a high refresh rate can be inefficient with respect to energy consumption because often times the entire area of the display monitor is refreshed without regards to the size of the video being displayed. Therefore, even if the user of the computing device is streaming a small video on a large display monitor, the refresh rate will be dynamic with respect to the dimensions of the video. Because the hardware of many computing devices is not designed to adjust refresh rates according to the application being executed, the user is often left with a device that cannot maintain charge during periods of frequent media playback. The user is therefore often discouraged from displaying media streams until the user can plug their computing device into a charging port, or until the user knows that they will not need the battery life for other applications at certain points in the day. Additionally, idle screens displaying animations for various applications can also consume energy in a wasteful manner despite many processes of the application occurring on a cloud server rather than the computing device. In this way, an application can in some cases consume more energy merely for aesthetics rather than the primary purpose of the application.

SUMMARY

This paper describes various embodiments that relate to methods and apparatus for controlling the refresh rate of display devices. In some embodiments, a display device, such as a liquid crystal display (LCD) or a light emitting diode (LED) display, is set forth. The display device can include a pixel array, a gate driver operatively coupled to the pixel array, and a data driver operatively coupled to the pixel array. The display device can further include a control circuit operatively coupled to the gate driver. The control circuit can be configured to provide a normal refresh signal to the gate driver when a row of a first set of frame data is different than a row of a second set of frame data, and also provide a modified refresh signal to the gate driver when the row of the first set of frame data is the same as the row of the second set of frame data.

In other embodiments, a method for refreshing multiple areas of a display device concurrently at different refresh rates is set forth. The method can include generating a first data frame and a second data frame, and comparing multiple rows of the first data frame to multiple rows of the second data frame. The method can further include determining a modified row of the second data frame, wherein the modified row is a row of data in the second data frame that is different than the corresponding row of data in the first data frame. Additionally, the method can include causing a first portion of the display device corresponding to the modified row of the second data frame to refresh at a first refresh rate, and causing a second portion of the display device adjacent to the first portion of the display device to refresh at a second refresh rate.

In yet other embodiments, a machine-readable non-transitory storage medium is set forth. The storage medium can store instructions that, when executed by a processor included in a computing device, cause the computing device to carry out steps that include receiving a first data frame and a second data frame corresponding to image data to be displayed on a display device. The steps can further include comparing a first group of rows of the first data frame to both a second group of rows and third group of rows in the second data frame. Additionally, the steps can include determining that a first subset of rows of the first group of rows is different than the second group of rows, and determining that a second subset of rows of the first group of rows is the same as the third group of rows. Moreover, the steps can include causing a first group of driver circuits corresponding to the second group of rows to transition into a high state, and causing a second group of driver circuits corresponding to the third group of rows to transition into a low state.

In other embodiments, a computing device is set forth. The computing device can include a processor, a memory, and a display system. The display system can include a data driver, and a gate driver including a plurality of gate outputs electrically coupled to a plurality of selector circuits each configured to periodically output a scan signal according to a control signal generated by control circuitry electrically coupled to each selector circuit. Furthermore, the control circuitry can be configured to cause the plurality of selector circuits to concurrently operate according to different refresh rates based on frame data generated by the data driver.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
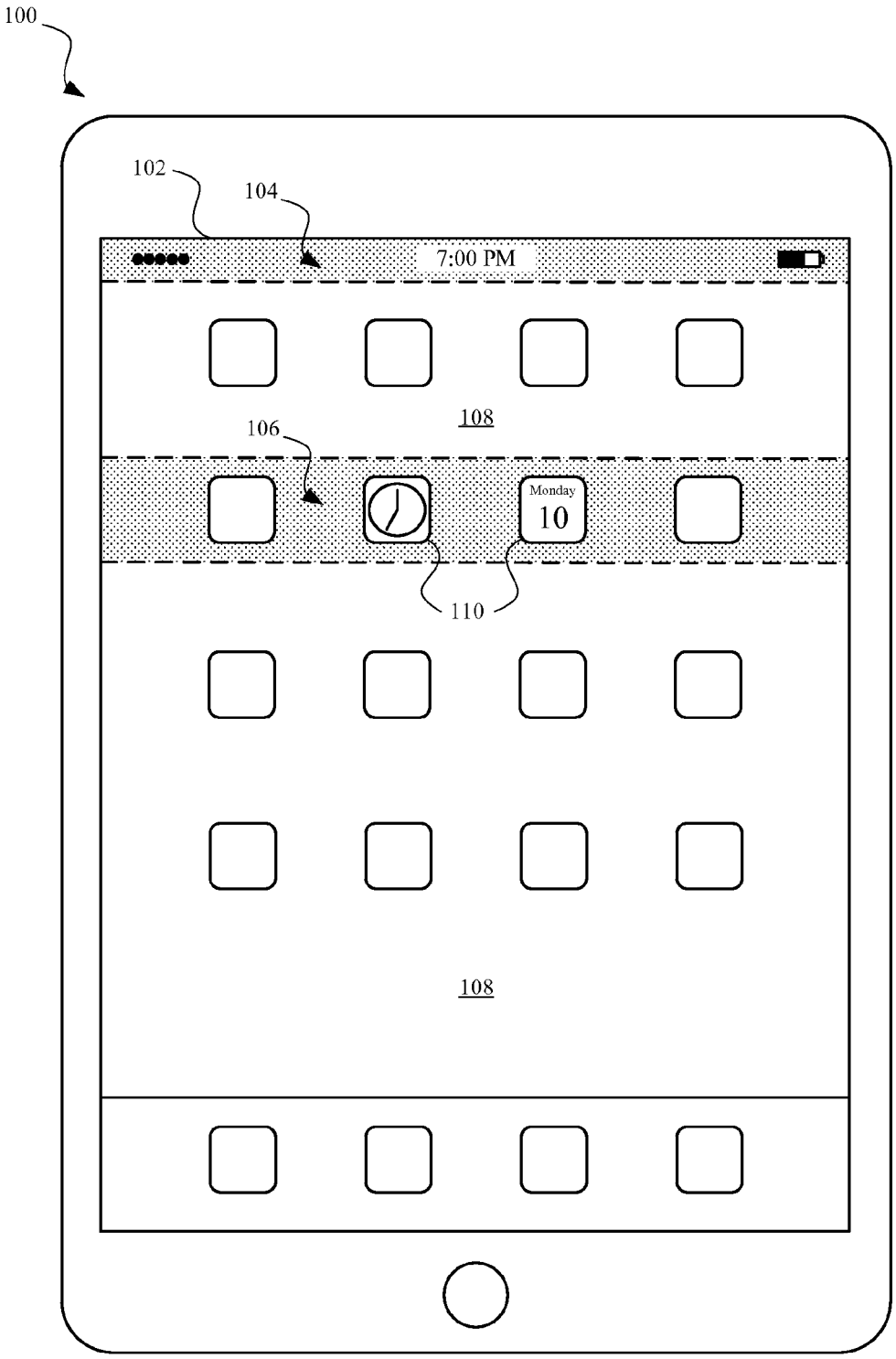
FIG. 1 illustrates a computing device having a display with multiple areas where the displayed graphics are either static or dynamic.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The embodiments discussed herein relate to display devices configured to refresh at different rates based on the content to be displayed by the display devices. Many computing device have displays that often display static and dynamic images over various periods of usage. The static and dynamic images can often be displayed concurrently over the display of the computing device. According to the embodiments discussed here, a lower refresh rate can be assigned to portions of the display that are displaying a static image, while a normal refresh rate can be assigned to portions of the display that are displaying a dynamic image. These differences in refresh rates can be accomplished in part by an output selector circuit that can prevent the updating of one or more rows of the display. Specifically, the display can include an LED array having multiple rows, and each row can be connected to a gate driver that can be prevented from allowing a refresh of a respective row based on actions of the output selector circuit. In some instances, a data driver provides updated frame data to the LED array, and if the updated frame data is the same for two or more refreshes the gate driver can prevent the refresh of one or more rows of the LED array. For example, when the LED array is outputting a static image at a portion of the LED array, a control signal can be provided to the output selector that prevents that portion of the LED array from being refreshed at a rate equal to other portions of the LED array. Single rows or groups of rows can be refreshed differently than other portions of the LED array such that at least two refresh rates are being used to provide output from the LED array. In some embodiments, the refresh rate assigned to a portion of the LED array can be based on the flicker content of the image or images to be output by the LED array. For example, when the images contain high flicker content, the corresponding portion of the LED array can be assigned a low refresh rate. Moreover, when the images contain low flicker content, the corresponding portion of the LED array can be assigned an extremely low refresh rate. Additionally, during each refresh a polarity alteration can be performed in order to mitigate wear of the LED's of the LED array.

When multiple refresh rates are concurrently used on a display device, a ripple may be visible by a user of the computing device on which the display device is attached. The ripple can be caused by a boundary between two adjacent portions of the display that are operating at different refresh rates. In order to mitigate and prevent the occurrences of ripples, methods of compensation are discussed herein. In one embodiment, a digital compensation method is used. The digital compensation method allows for at least a 2-bit spatial dithering to be performed on the data presented at the display boundary at issue. In another embodiment, an interpolation process is used, which interpolates at least two gamma curves based on the refresh rate of one or more rows at issue. The result of the interpolation is output to the one or more rows at issue in order to adjust the gamma of the images to be displayed at the one or more rows, for rendering any ripple effect imperceptible.

These and other embodiments are discussed below with reference to FIGS. 1-11; however, those skilled in the art will readily appreciate that the detailed description given herein with respect to these figures is for explanatory purposes only and should not be construed as limiting.

FIG. 1 illustrates a computing device 100 having a display 102 with multiple areas where the displayed graphics are either static or dynamic. Specifically, the display 102 of the computing device 100 includes a header row 104 and a dynamic icon row 106 that constantly update according to a cycle or period programmed within the computing device 100. The display 102 also includes static area 108, which do not constantly update but rather remain static until input is received from the user, a network connection, or other suitable source of input for the computing device 100. The header row 104 can include an indicator for wireless signal strength, clock time, and battery life, which typically can change at any given moment in time. For this reason, the header row 104 must display different values and adjust according to the dynamic changes occurring. The dynamic icon row 106 can also be modified according to updates occurring at the dynamic icons 110. The dynamic icons 110 can display the current date and clock time, which changes and updates constantly. In this way, the dynamic icons 110 should be refreshed more frequently than the static areas 108 in order to reduce energy consumption, as further discussed herein. For example, during the operation of an application on the computing device 100, a display manager stored in the computing device 100 can determine whether one or more rows currently presented on the display 102 include dynamic data. Thereafter, and as further discussed herein, the rows that include dynamic data can be assigned, by the display manager, a refresh rate that is higher than the rows that do not include dynamic data.

Figure 2:
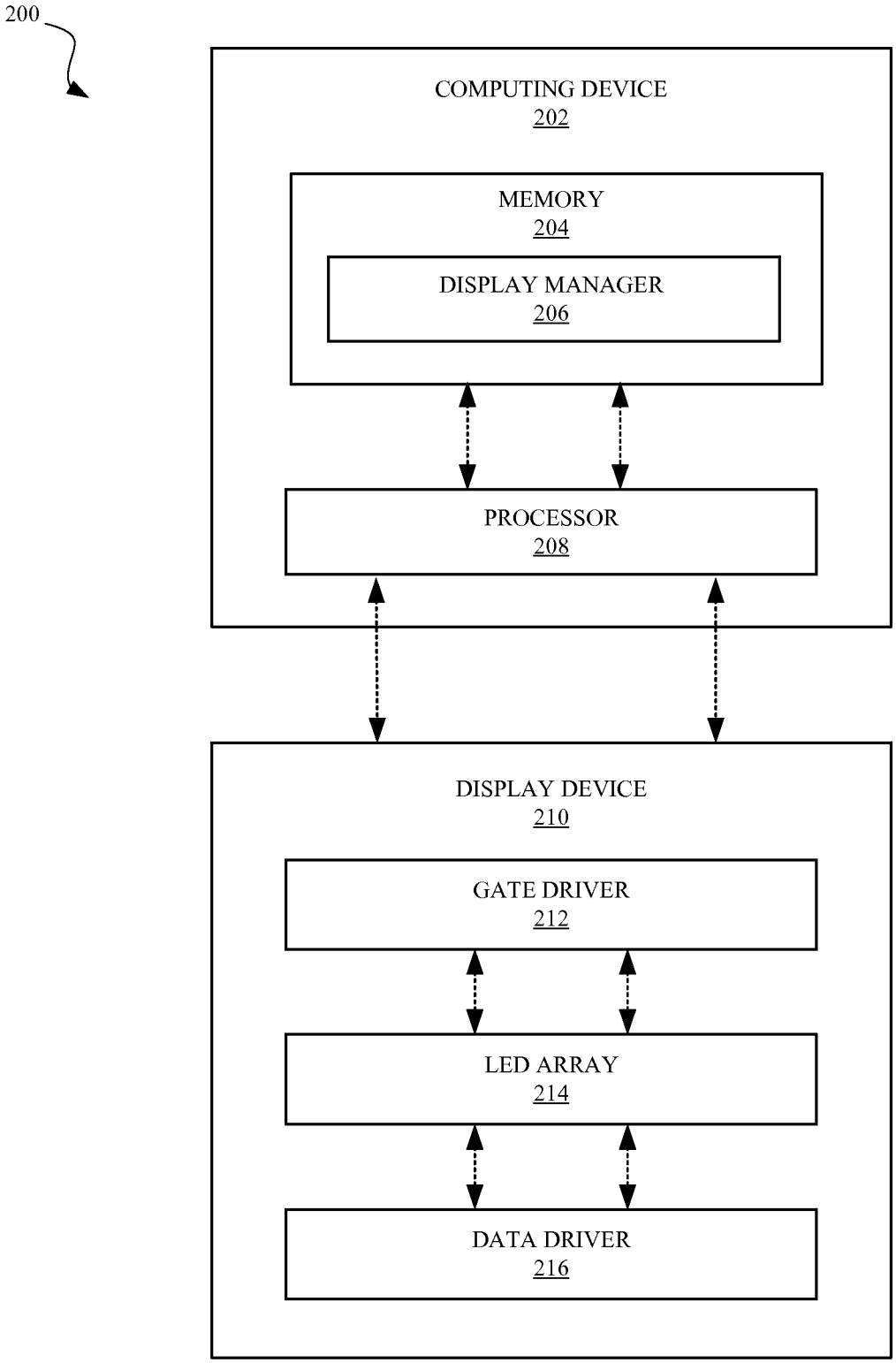
FIG. 2 illustrates a system diagram for controlling a display device according to some embodiments discussed herein.

FIG. 2 illustrates a system diagram 200 for controlling a display device 210 according to some embodiments discussed herein. Specifically, FIG. 2 illustrates how the computing device 202 disclosed herein interacts with the display device 210 in order to simultaneously assign different refresh rates to various areas of the display device 210 in order to save battery life of the computing device 202. The computing device 202 can include a memory 204 storing a display manager 206 for transmitting display data between the processor 208 and display device 210. The display device 210 can include a data driver 216 for providing the display data to a light emitting diode (LED) array 214. The LED array 214 can include any suitable type of LED for displaying at a display device 210. For example, the LED array 214 can be an array of organic light emitting diodes. A gate driver 212 can be responsible for providing power to the individual LED's of the display device 210 and scanning rows and/or columns of the LED array 214 according to a refresh rate provided from the display manager 206. The display device can include multiple gate drivers 212, multiple data drivers 216, and multiple LED arrays 214, arranged in any suitable manner for operating a display device 210. The data drivers 216 and the gate drivers 212 can be configured to control the luminance of each LED pixel on the display device 210. Additionally, the display device 210 can be any suitable display monitor for use by a computing device such as a desktop computer, mobile device, media player, or any other computer-related device. In some embodiments, the display device 210 is a liquid crystal display (LCD) with an LED backlight. The LED backlight can be decoupled from the gate drivers 212 and data drivers 216, and the gate drivers 212 and data drivers 216 can be used to control the transmittance of the liquid crystals for passing through LED light from the LED backlight. In this way, the liquid crystals, or the LED's of the LED array discussed herein, can act as a pixel array to provide a channel or source for light to be projected from the display device 210.

Figure 3:
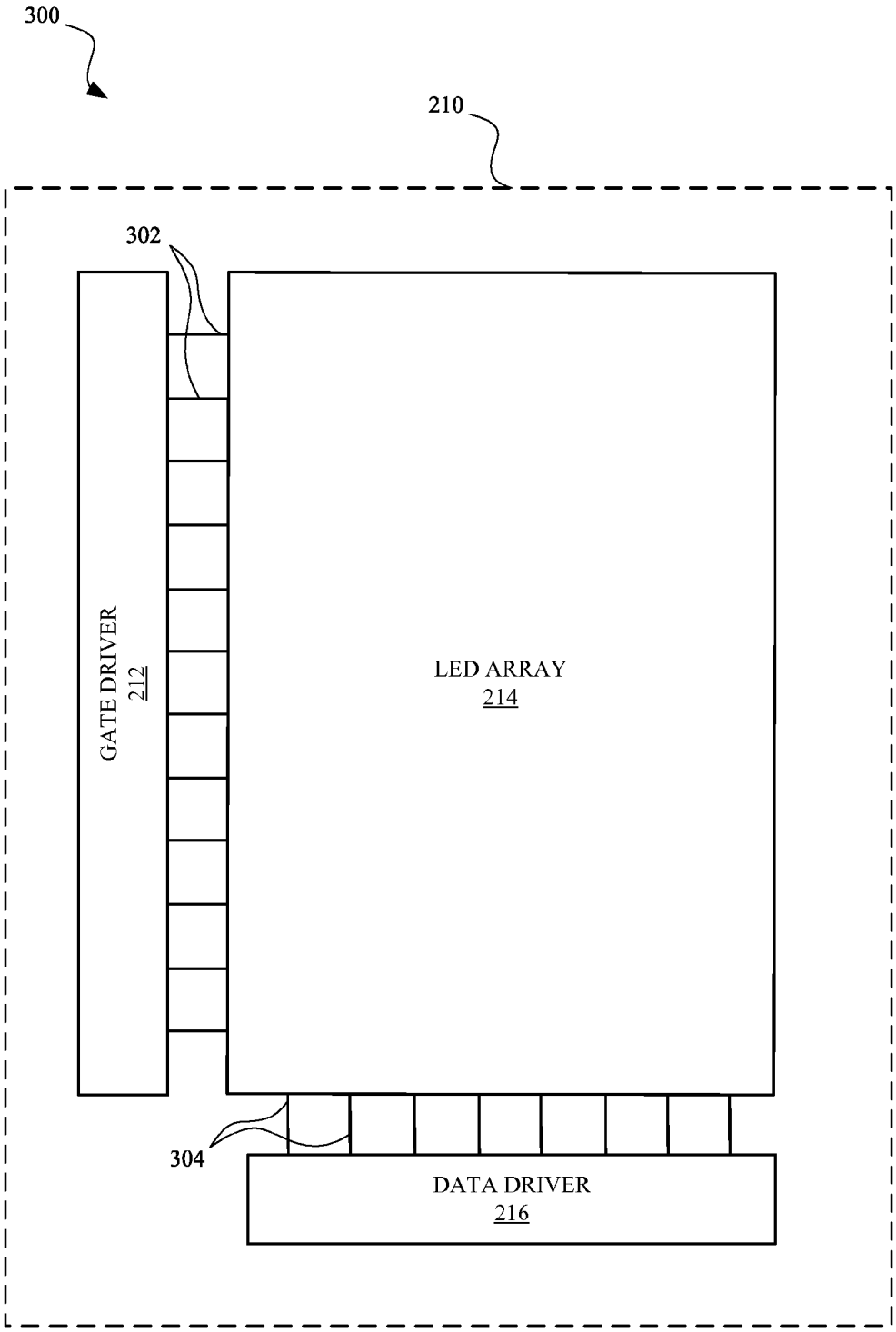
FIG. 3 illustrates a diagram of the display device having a light emitting diode (LED) array connected to a gate driver and data driver.

FIG. 3 illustrates a diagram 300 of the display device 210 having an LED array 214 connected to a gate driver 212 and data driver 216. As further discussed herein, the gate driver 212 can include multiple gate output controllers that provide power to each row and/or column of the LED array and scan for data outputs. Each gate output 302 can be limited by a refresh rate for each individual row or group of rows, according to embodiments discussed herein. In this way, one or more gate outputs 302 can refresh at a different rate than one or more other gate outputs 302. Additionally, the data driver 216 can include multiple data outputs 304 for updating and transmitting signals to the LED array 214. In some embodiments, the one or more data outputs 304 can be stopped or transitioned into a low output state in order to reduce power consumption when the LED array 214 is displaying static images on the screen. Additionally, when the data outputs 304 are stopped or in a low state, the refresh rate corresponding to the gate outputs 302 can be reduced in areas affecting the portions of the LED array 214 displaying a static image.

Figure 4A:
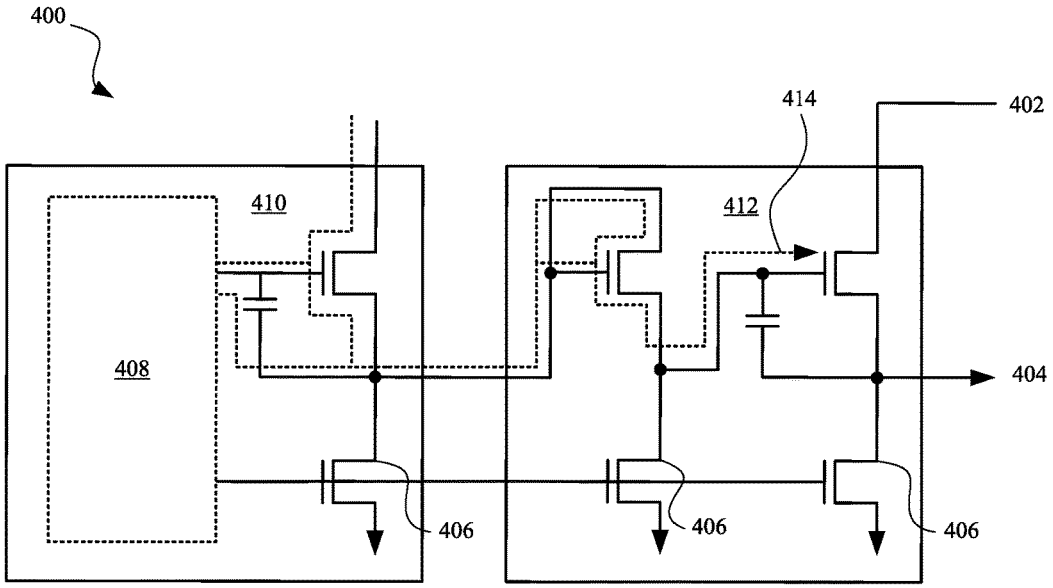
FIGS. 4A-4B illustrate a gate driver circuit having a unit circuit and an output selector circuit.
Figure 4B:
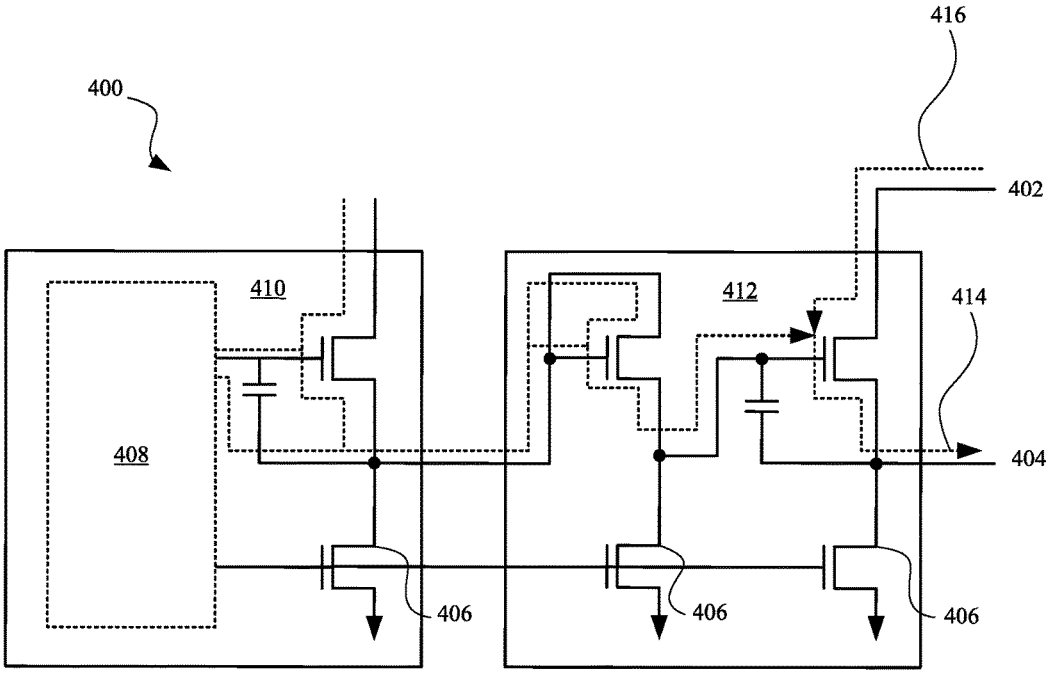

FIGS. 4A-4B illustrate a gate driver circuit 400 having a unit circuit 410 and an output selector 412. The gate driver circuit 400 includes a control circuit 408 connected to multiple transistors and inputs for allowing the control circuit 408 to scan for updates from the data driver 216. One or more of the multiple transistors can be oxide transistors (e.g., oxide thin-film transistors), which provide for extremely low off-state currents, thereby allowing for less power consumption when a low refresh rate is applied to the LED array 214, as further discussed herein. Additionally, by using oxide transistors in combination with an LED array 214 of organic LED's, a significant reduction in power consumption can be achieved as compared to displays using low temperature polysilicon. Therefore, the apparatus and methods discussed herein can be implemented using a gate driver circuit 400 having one or more oxide thin-film transistors connected to an LED array 214 of organic LED's. Furthermore, in some embodiments, the gate drive circuit 400 can be incorporated into each gate output 302 in order to scan one or more rows concurrently based on one or more clock signals provided to the gate driver circuit 400. The output selector 412 is incorporated into the gate driver circuit 400 in order to prevent scanning based on the control input 402. For example, as shown in FIG. 4A, a scan signal 414 can be provided to the output selector 412 and prevented from being output from the selector output 404 by the absence of a control input 402. When a control input 402 is not provided to the output selector 412, either no signal or a low voltage signal can be output from the selector output 404. FIG. 4B illustrates an example of when a control signal 416 is received at the control input 402 of the output selector 412. As a result of the control signal 416, a conductive pathway is formed at a transistor between the control input 402 and selector output 404, thereby allowing the scan signal 414 to be output from the selector output 404. The scan signal 414 can be a high voltage, in the context of a logical circuit to which the scan signal is provided, in order to indicate an "on" or "high" state of operation. Therefore, although the scan signal 414 can be constantly applied throughout the gate driver circuit 400, the scan signal 414 will not be output from the selector output 404 until the control signal 416 is received at the control input 402. In this way, because the gate driver circuit 400 can be incorporated at each gate output 302, one or more rows of gate outputs can be prevented from outputting a scan signal 414, or caused to output an "off" or "low" signal, simply by applying the control signal 416 to one or more gate driver circuits 400.

Figure 5:
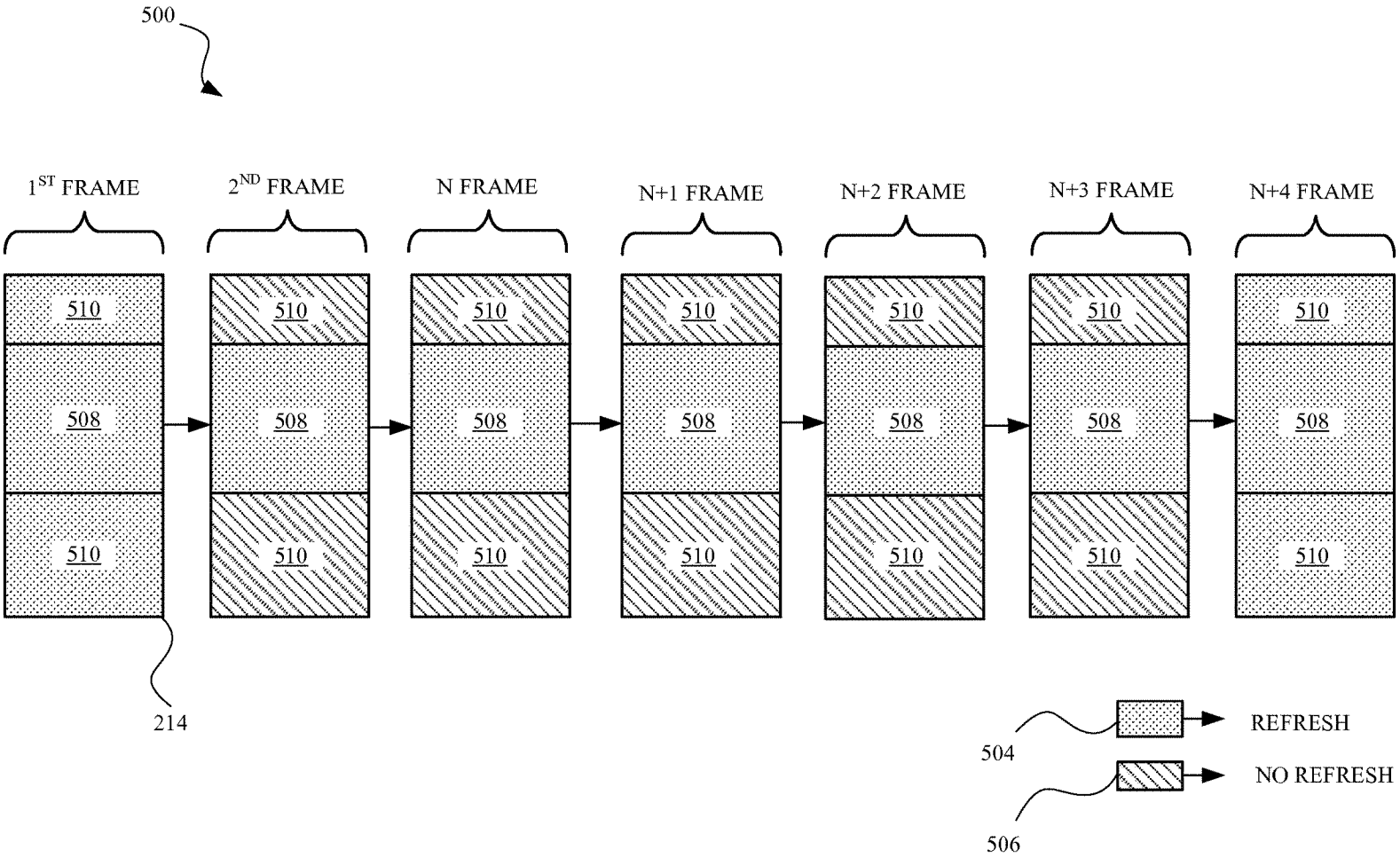
FIG. 5 illustrates a diagram setting forth how multiple rows and areas of an LED array can be refreshed at different rates based on the operation of the gate driver circuit.

FIG. 5 illustrates a diagram 500 setting forth how multiple rows and areas of an LED array 214 can be refreshed at different rates based on the operation of the gate driver circuit 400. Specifically, FIG. 5 sets forth an example of when a first refresh rate is assigned to a first area 508 of the LED array 214 that is greater than a second refresh rate that is assigned to a second area 510 of the LED array 214. At the 1st frame, both the first area 508 and the second area 510 are refreshed based on a scan performed on all rows of the LED array 214 as a result of both the first refresh rate and the second refresh rate. For purposes of explanation, the first area 508 can be a streaming video and the second area 510 can be a static image bordering the streaming video. From the second frame to the "N+3" frame, the first refresh rate causes the rows corresponding to the first area 508 to be refreshed at each frame in order to allow the streaming video to be updated at each frame. However, the second refresh rate causes the rows corresponding to the second area 510 to not be refreshed and remain static as a result of the second refresh rate being lower than the first refresh rate. At the "N+4" frame, the first area 508 and second area 510 refresh concurrently again after the second area 510 has remained unrefreshed for multiple consecutive frames. In this way, energy is saved by refreshing portions of the LED array 214 at different refresh rates as opposed to refreshing the entire LED array 214 at the same rate. In some embodiments, any suitable number of refresh rates can be applied to the LED array 214. For example, at least three different refresh rates can be applied to the LED array 214. Additionally, a minimum refresh rate can be determined for one or more rows of the LED array 214. The minimum refresh rate can be the lowest refresh rate that prevents flickering of an image being displayed by the LED array 214. Moreover, polarity alteration can be performed during each refresh that is performed at a respective area or row of the LED array 214.

Figure 6A:
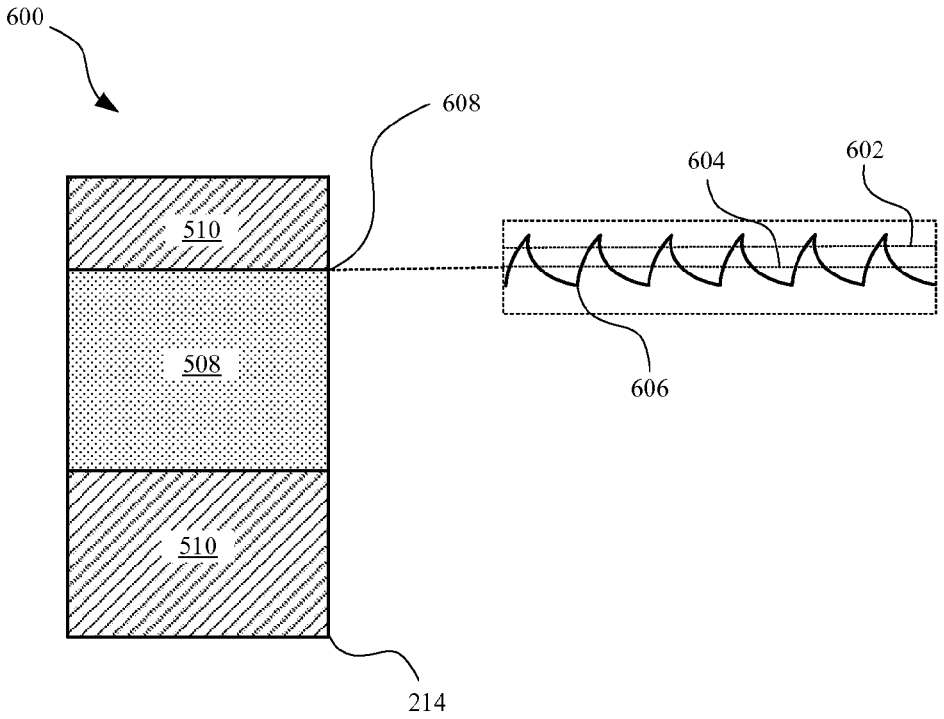
FIGS. 6A-6B illustrate issues and solutions associated with providing multiple refresh rates to the LED array.
Figure 6B:
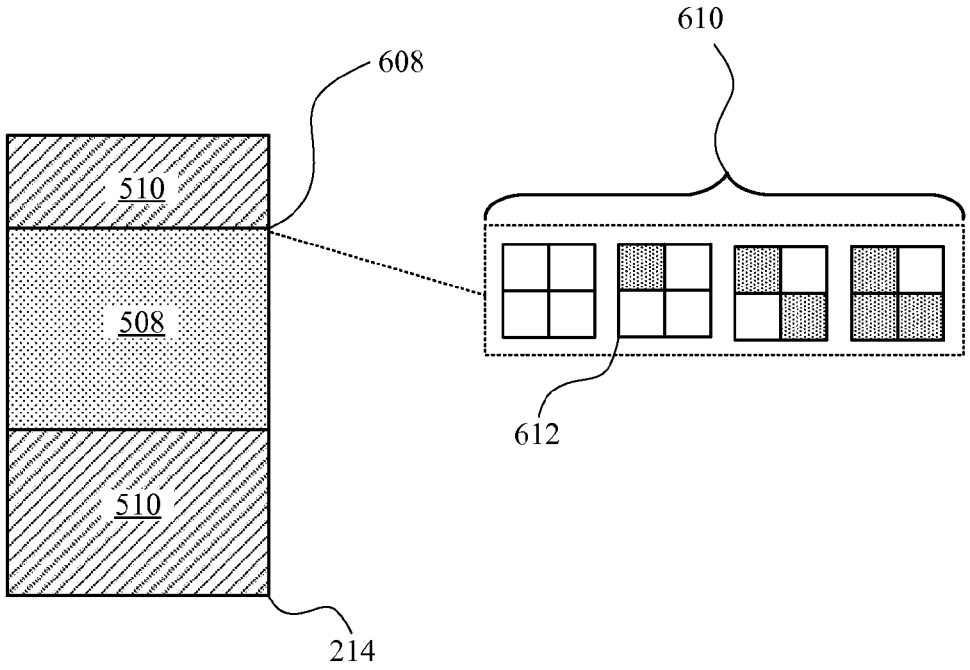

FIGS. 6A-6B illustrate issues and solutions associated with providing multiple refresh rates to the LED array 214. Specifically, FIG. 6A illustrates a representation of a refresh boundary 608 that can be visible to a user when the refresh rate of a first area 508 is greater than the refresh rate of a second area 510. A representation of the refresh boundary 608 can be seen in FIG. 6A where an average refresh line 606 is illustrated. The average refresh line 606 is an example of when a first refresh rate 602 is greater than a second refresh rate 604, and both refresh rates are concurrently exhibited adjacent to a refresh boundary 608. As a result of the average refresh line 606, a flicker or luminance ripple will be visible unless the refresh boundary 608 is compensated. In order to resolve the issues of flicker and ripple, solutions are set forth in FIGS. 6B and 7. Specifically, FIG. 6B illustrates how compensation for the refresh boundary 608 can be performed in the digital domain using a set of pixels 610 that can be interchanged over the refresh boundary 608 based on the refresh rate. For example, for each set of at least 2-by-2 pixels traversing the refresh boundary 608, each block of pixels 612 illustrated in the set of pixels 610 can be sequenced and/or alternated. This technique, sometimes referred to as spatial dithering, can be performed in order to provide a visually smooth transition between two areas having different refresh rates.

Figure 7:
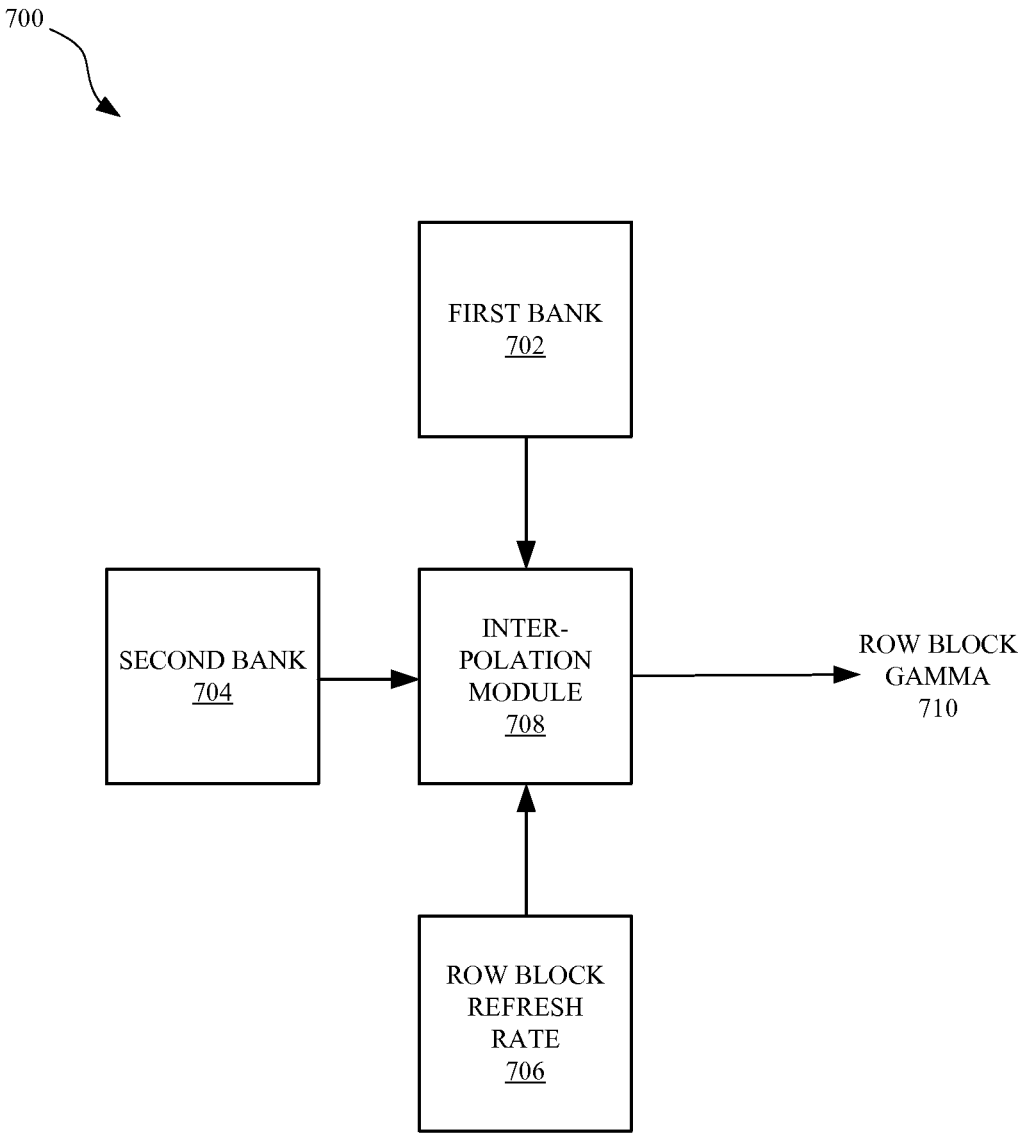
FIG. 7 illustrates a diagram for performing multiple bank and multiple parameter gamma distribution in order to mitigate flickering and ripple issues at the refresh boundary.

FIG. 7 illustrates a system diagram 700 for performing multiple bank and multiple parameter gamma distribution in order to mitigate flickering and ripple issues at the refresh boundary 608. Specifically, FIG. 7 illustrates an analog solution for applying gamma switching to a row or block of rows in order to correct flickering and ripple. The system diagram 700 includes a first bank 702 that stores a first gamma curve and a second bank 704 that stores a second gamma curve. Each of the first gamma curve and second gamma curve are associated with one of the two refresh rates that can be applied to the LED array 214 respectively. During a compensation operation using gamma switching, the first gamma curve and second gamma curve are input into an interpolation module 708 along with a row block refresh rate 706. The first gamma curve and second gamma curve are thereafter interpolated. The method of interpolation can be any suitable form of interpolating image data. The result of an interpolation of the first gamma curve and second gamma curve can be scaled or otherwise modified according to the row block refresh rate 706 provided to the interpolation module 708. As a result, the row block gamma 710 is output as a curve from the interpolation module 708 in order to provide an analog solution that hides the refresh boundary 608. The row block gamma 710 can be applied to one or more rows of the LED array 214 concurrently depending on the severity of the flickering and rippling occurring at the refresh boundary 608.

Figure 8:
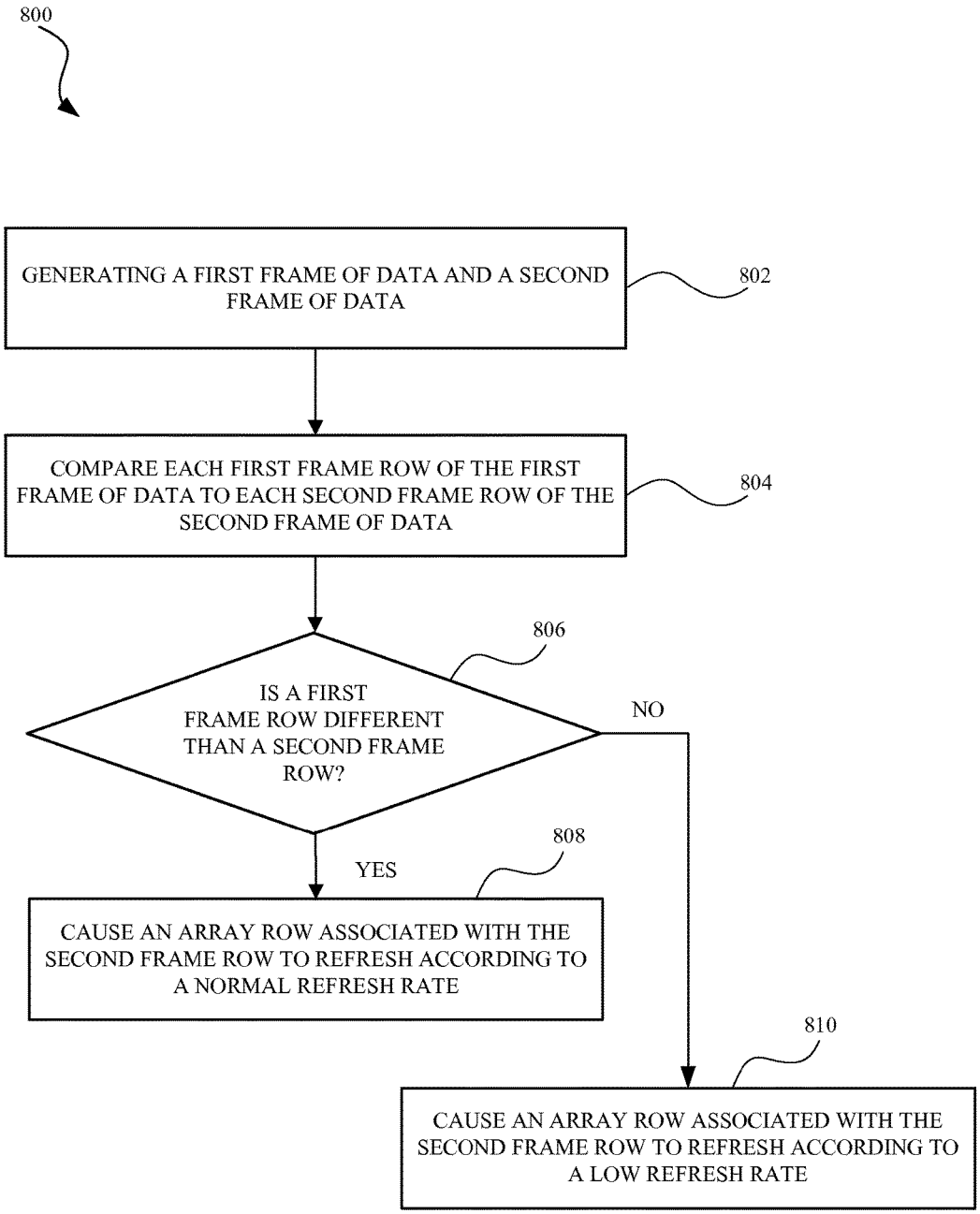
FIG. 8 illustrates a method for modifying a refresh rate of a row or group of rows based on differences between frames provided to the LED array.

FIG. 8 illustrates a method 800 for modifying a refresh rate of a row or group of rows based on differences between frames provided to the LED array 214. Specifically, the method 800 includes a step 802 of generating, by a display manager 206, a first frame of data and a second frame of data. The first and second frames of data can be generated at the computing device 202 or the display device 210, by one or more software modules within either or both respective devices. At step 804, the display manager 206 compares each first frame row (i.e. a row of the first frame of data) and each second frame row (i.e. a row of the second frame of data). The comparison of step 804 can be done consecutively or one at a time for each row, or the comparison of all the rows can be performed concurrently. At step 806, the display manager 206 determines whether a first frame row is different than a second frame row. If the first frame row is different than the second frame row, the display manager 206, at step 808, causes an array row associated with the second frame row to refresh according to a normal refresh rate. If the first frame row is not different than the second frame row, the display manager 206, at step 810, causes an array row associated with the second frame row to refresh according to a low refresh rate. In this way, rows of a frame that remain static over multiple consecutive frames can be kept at a low refresh rate in order to save energy. For example, a normal refresh rate can be 30 Hertz or 60 Hertz, a low refresh rate can be 10 Hertz or 2 Hertz, and an extremely low refresh rate can be 1 Hz. The normal refresh rate, low refresh rate, and extremely low refresh rate can be any suitable value or values for a given display device. The normal refresh rate can be greater than the low refresh rate, and the low refresh rate can be greater than an extremely low refresh rate, as further discussed herein.

Figure 9:
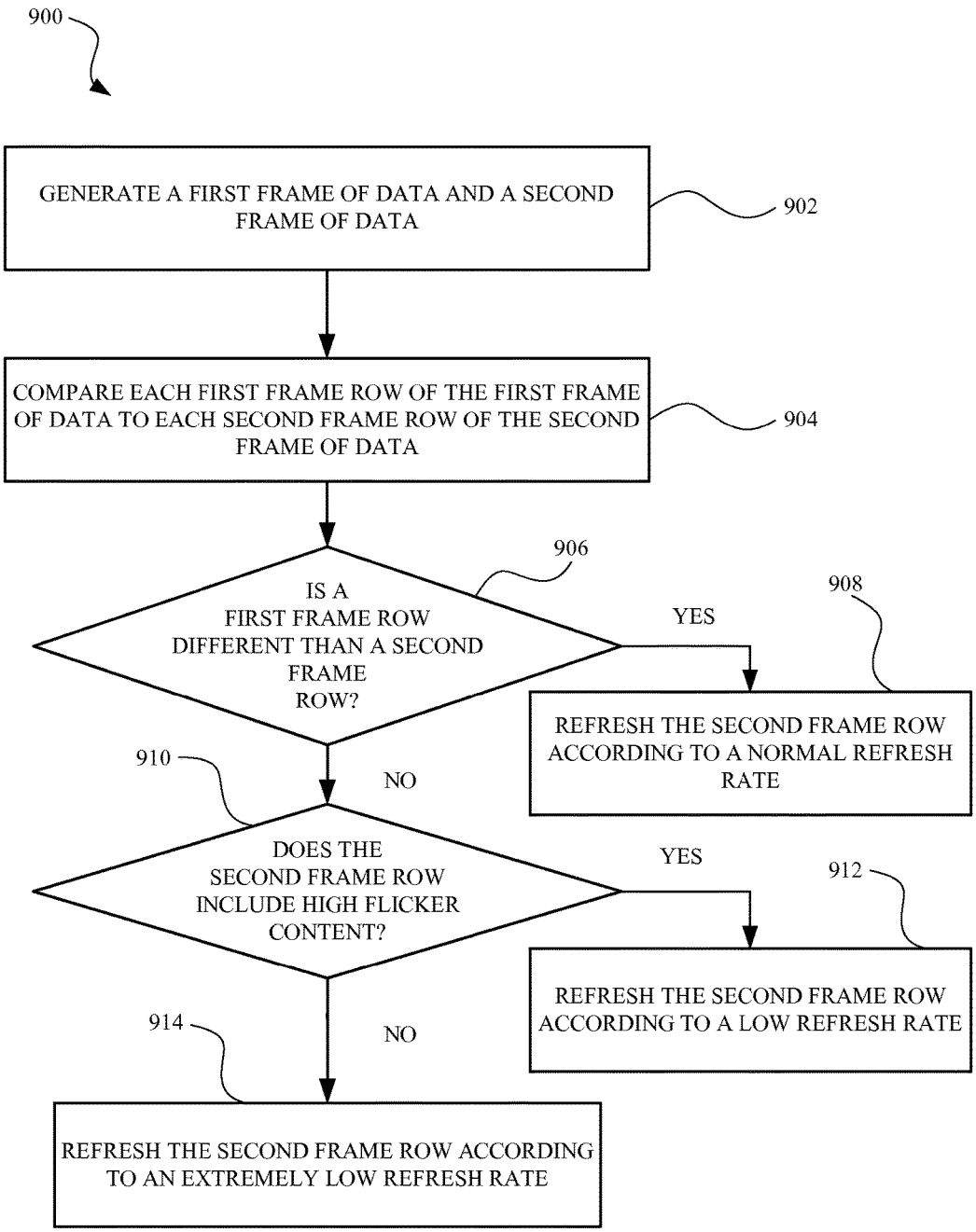
FIG. 9 illustrates a method for adjusting a refresh rate of one or more rows of and LED array based on flicker content of one or more frames, or images to be displayed by the LED array.

FIG. 9 illustrates a method 900 for adjusting a refresh rate of one or more rows of an LED array 214 based on flicker content of one or more frames, or images to be displayed by the LED array 214. Flicker content or flickering refers to the amount or severity of noticeable transitions from frame to frame a user can perceive when viewing a display of a computing device. The method 900 includes a step 902 where the display manager 206 generates a first frame of data and a second frame of data. Each of the first frame and second frame of data include one or more rows of data to be provided to the LED array 214. The display manager 206, at step 904, compares each first frame row of the first frame and each second frame row of the second frame. Thereafter, at step 906, the display manager 206 determines whether a first frame row is different than a second frame, for one or more of the first frame rows of the first frame and for one or more of the second frame rows of the second frame. If any of the first frame rows are different than a corresponding second frame row, the display manager 206, at step 908, can refresh the respective second frame row or rows according to a normal refresh rate. If any of the first frame rows are the same as a corresponding second frame row, the display manager 206 can proceed to step 910. At step 910, the display manager 206 can determine whether the any of the second frame rows include high flicker content. If any of the second frame rows include high flicker content (e.g., content that would cause a user to notice flickering from the LED array 214), the display manager 206, at step 912, can refresh the second frame row according to a low refresh rate. The refresh rates provided herein can be assigned to one or more transitions between frames such that the next transition can be delayed according to the respective refresh rate. If the any of the second frame rows do not contain high flicker content, the display manager 205, at step 914, can refresh the respective second frame rows according to an extremely low refresh rate. In this way, the row or rows assigned the extremely low refresh rate can remain static longer in order to conserve energy. Any of the methods discussed herein can iteratively analyze a single row at a time or multiple rows concurrently in order to efficiently determine a suitable refresh rate for one or more rows of the LED array 214.

Figure 10:
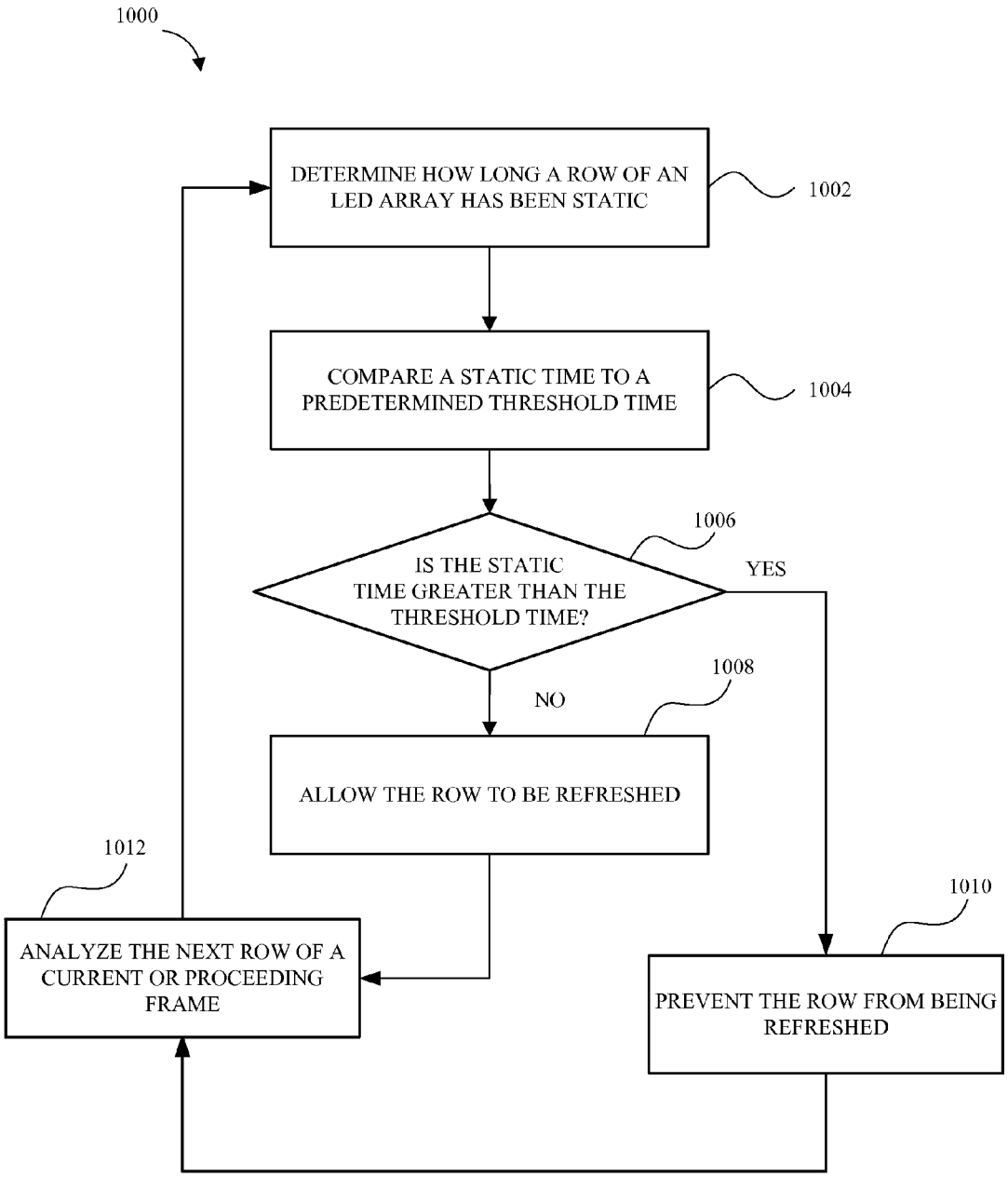
FIG. 10 illustrates a method for refreshing one or more rows of the LED array according to the amount of time one or more rows has remained static or unchanged.

FIG. 10 illustrates a method 1000 for refreshing one or more rows of the LED array 214 according to the amount of time one or more rows has remained static or unchanged. The method 1000 includes a step 1002 where the display manager 206 determines how long a row, or rows, of the LED array 214 has been static. At step 1004, the display manager 206 compares a static time, or the time the row or rows has remained static or unchanged, to a predetermined threshold time. The threshold time can be a value set by a user or manufacturer that remains constant throughout the life of the LED array 214 or changes based on hardware changes to the computing device associated with the LED array 214. At step 1006, the display manager 206 determines whether the static time is greater than the threshold time. If the static time is greater than the threshold time, the display manager 206, at step 1010, can prevent the row or rows from being refreshed. In this way, the refresh rate of one or more rows of the LED array 214 will be based on an amount of time the one or more rows has been static. If the static time is less than or equal to the threshold time, the display manager 206, at step 1008, can allow the row or rows to be refreshed. Following steps 1008 and 1010, the display manager 206, at step 1012, can analyze the next row or rows of a current frame or proceeding frame. For example, the method 1000 can be performed on each frame of data provided to the LED array 214, and for each row of each frame. When the all of the frames have been analyzed according to the method 1000, the display manager 206 can proceed to the next frame to be provided to the LED array 214. It should be noted that any method or embodiment discussed herein can be combined and performed in any order or arrangement suitable for mitigating energy consumption of a display device.

Figure 11:
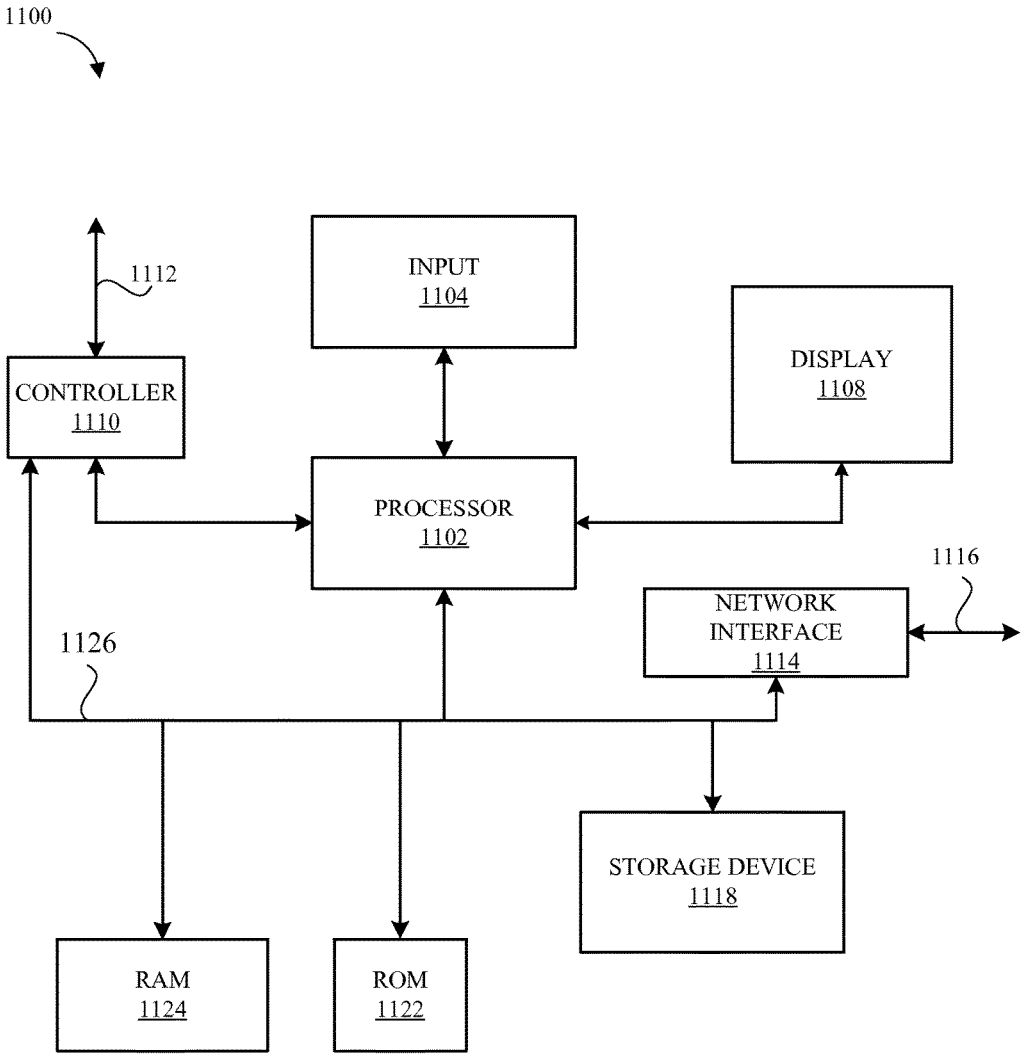
FIG. 11 is a block diagram of a computing device that can represent the components of the various embodiments discussed herein.

The FIG. 11 is a block diagram of a computing device 1100 that can represent the components of the computing device 100 and/or the computing device 202. It will be appreciated that the components, devices or elements illustrated in and described with respect to FIG. 11 may not be mandatory and thus some may be omitted in certain embodiments. The computing device 1100 can include a processor 1102 that represents a microprocessor, a coprocessor, circuitry and/or a controller for controlling the overall operation of computing device 1100. Although illustrated as a single processor, it can be appreciated that the processor 1102 can include a plurality of processors. The plurality of processors can be in operative communication with each other and can be collectively configured to perform one or more functionalities of the computing device 1100 as described herein. In some embodiments, the processor 1102 can be configured to execute instructions that can be stored at the computing device 1100 and/or that can be otherwise accessible to the processor 1102. As such, whether configured by hardware or by a combination of hardware and software, the processor 1102 can be capable of performing operations and actions in accordance with embodiments described herein.

The computing device 1100 can also include user input device 1104 that allows a user of the computing device 1100 to interact with the computing device 1100. For example, user input device 1104 can take a variety of forms, such as a button, keypad, dial, touch screen, audio input interface, visual/image capture input interface, input in the form of sensor data, etc. Still further, the computing device 1100 can include a display 1108 (screen display) that can be controlled by processor 1102 to display information to a user. Controller 1110 can be used to interface with and control different equipment through equipment control bus 1112. The computing device 1100 can also include a network/bus interface 1114 that couples to data link 1116. Data link 1116 can allow the computing device 1100 to couple to a host computer or to accessory devices. The data link 1116 can be provided over a wired connection or a wireless connection. In the case of a wireless connection, network/bus interface 1114 can include a wireless transceiver.

The computing device 1100 can also include a storage device 1118, which can have a single disk or a plurality of disks (e.g., hard drives) and a storage management module that manages one or more partitions (also referred to herein as "logical volumes") within the storage device 1118. In some embodiments, the storage device 1120 can include flash memory, semiconductor (solid state) memory or the like. Still further, the computing device 1100 can include Read-Only Memory (ROM) 1122 and Random Access Memory (RAM) 1124 and. The ROM 1122 can store programs, code, instructions, utilities or processes to be executed in a non-volatile manner. The RAM 1124 can provide volatile data storage, and stores instructions related to components of the storage management module that are configured to carry out the various techniques described herein. The computing device can further include data bus 1126. Data bus 1126 can facilitate data and signal transfer between at least processor 1102, controller 1110, network interface 1114, storage device 1118, ROM 1122, and RAM 1124.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable storage medium is any data storage device that can store data which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion. In some embodiments, the computer readable storage medium can be non-transitory.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A display device, comprising:

a pixel array;

a first group of gate drivers and a second group of gate drivers each operatively coupled to the pixel array;

a data driver operatively coupled to the pixel array to provide frame data to the pixel array; and a control circuit operatively coupled to a gate driver of the first group or the second group, wherein the control circuit is configured to:

provide a normal refresh signal to the gate driver when a row of a first set of frame data is different than a row of a second set of frame data;

provide a modified refresh signal to the gate driver when the row of the first set of frame data is the same as the row of the second set of frame data; and wherein the control circuit is configured to (i) cause the first group of gate drivers to refresh a first portion of the pixel array at a normal refresh rate, (ii) cause the second group of gate drivers to refresh a second portion of the pixel array at a modified refresh rate, and (iii) when there are different refresh signals concurrently in use in the pixel array, perform compensation on the frame data to mitigate perception of ripples at a refresh boundary.

2. The display device of claim 1, wherein the normal refresh signal is provided to the gate driver when a control signal is received by the control circuit and the control signal causes a circuit component to create a conductive pathway for the normal refresh signal to pass through.

3. The display device of claim 1, wherein the normal refresh signal causes the pixel array to refresh at the normal refresh rate, the modified refresh signal causes pixel array to refresh at the modified refresh rate, and the normal refresh rate is greater than the modified refresh rate.

4. The display device of claim 1, further comprising:

a plurality of control circuits configured to provide the modified refresh signal and the normal refresh signal concurrently to the pixel array; and wherein the pixel array includes:

multiple liquid crystals configured to control a transmittance of light from a light emitting diode (LED) backlight, or multiple organic LED's.

5. The display device of claim 1, wherein the compensation includes a row compensation operation within a frame at the refresh boundary, the refresh boundary is a result of the pixel array concurrently exhibiting the normal refresh rate at the first portion and the modified refresh rate at the second portion.

6. The display device of claim 5, wherein the row compensation operation includes performing a dithering operation across a row of the pixel array.

7. The display device of claim 5, wherein the row compensation operation includes performing an interpolation between at least two gamma curves associated with the at least one of the normal refresh rate and the modified refresh rate.

8. A computing device, comprising:

a display device, comprising:

a pixel array;

a first group of gate drivers and a second group of gate drivers each operatively coupled to the pixel array;

a data driver operatively coupled to the pixel array to provide frame data to the pixel array; and a control circuit operatively coupled to a gate driver, wherein the control circuit is configured to:

concurrently provide multiple different scan signals to the gate driver when a row of a first set of frame data is the same as a corresponding first row in a second set of frame data and different than a second row in the second set of frame data; and wherein the control circuit is configured to (i) cause the first group of gate drivers to refresh a first portion of the pixel array at a normal refresh rate, (ii) cause the second group of gate drivers to refresh a second portion of the pixel array at a modified refresh rate, and (iii) when there are different refresh signals concurrently in use in the pixel array, perform compensation on the frame data to mitigate perception of ripples at a refresh boundary.

9. The computing device of claim 8, wherein a scan signal is provided to the gate driver when a control signal is received by the control circuit and the control signal causes a transistor to create a conductive pathway for the scan signal to pass through.

10. The computing device of claim 8, wherein the multiple different scan signals include a normal scan signal and a modified scan signal wherein the normal scan signal corresponds to a higher scan rate than the modified scan signal.

11. The computing device of claim 10, further comprising:

a plurality of control circuits configured to provide the modified scan signal and the normal scan signal concurrently to the pixel array; and wherein the pixel array includes:

multiple liquid crystals configured to control a transmittance of light from a light emitting diode (LED) backlight, or multiple organic LED's.

12. The display device of claim 8, wherein the compensation includes a row compensation operation within a frame at the refresh boundary, the refresh boundary is a result of the pixel array concurrently exhibiting the normal refresh rate at the first portion and the modified refresh rate at the second portion.

13. The computing device of claim 12, wherein the row compensation operation includes performing an interpolation between at least two gamma curves associated with the normal refresh rate and the modified refresh rate.

14. A method for operating a display device, the method comprising:

receiving a first data frame and a second data frame corresponding to image data to be displayed on the display device;

comparing a first group of rows of the first data frame to both a second group of rows and third group of rows in the second data frame;

determining that a first subset of rows of the first group of rows is different than the second group of rows;

determining that a second subset of rows of the first group of rows is the same as the third group of rows;

causing a first group of driver circuits corresponding to the second group of rows to transition into a high state; and causing a second group of driver circuits corresponding to the third group of rows to transition into a low state.

15. The method of claim 14, wherein the high state causes the second group of rows to refresh, and the low state causes the third group of rows to remain unrefreshed.

16. The method of claim 14, further comprising:

determining whether the second group of rows and the third group of rows include flicker content that that is above or below a high flicker threshold or a low flicker threshold.

17. The method of claim 14, further comprising:

performing a dithering process at a border between the second group of rows and the third group of rows.

18. The method of claim 14, further comprising:

performing an interpolation of two gamma curves to compensate for a difference between at least two refresh rates corresponding to the second group of rows and the third group of rows.

* * * * *